US006527388B1

(12) United States Patent
Wang et al.

(10) Patent No.: US 6,527,388 B1
(45) Date of Patent: Mar. 4, 2003

(54) INK JET PRINTING METHOD

(75) Inventors: Yongcai Wang, Webster, NY (US); Lori J. Shaw-Klein, Rochester, NY (US); Thomas P. Nicholas, Rochester, NY (US); Sridhar Sadasivan, Rochester, NY (US); Lixin Chu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/021,757

(22) Filed: Dec. 12, 2001

(51) Int. Cl.[7] ..... B41J 2/05
(52) U.S. Cl. ..... 347/105; 428/195
(58) Field of Search ..... 347/105; 428/195

(56) References Cited

FOREIGN PATENT DOCUMENTS

| | | | | |
|---|---|---|---|---|
| EP | 0218956 A1 * | 4/1987 | ..... | B41M/1/36 |
| EP | 0803374 A2 * | 10/1997 | ..... | B41M/5/00 |
| EP | 1002660 | 5/2000 | | |
| EP | 1176030 A2 * | 1/2002 | ..... | B41M/5/00 |

* cited by examiner

*Primary Examiner*—John Barlow
*Assistant Examiner*—Manish S. Shah
(74) *Attorney, Agent, or Firm*—Harold E. Cole

(57) ABSTRACT

An ink jet printing method having the steps of: A) providing an ink jet printer that is responsive to digital data signals; B) loading the printer with ink jet recording element having a support having thereon in order: (I) a base layer of at least about 50% by weight of inorganic particles; and (II) an image-receiving layer of a) colloidal, inorganic oxide particles having a mean particle size of from about 10 to about 500 nm; and (b) water-insoluble, cationic, polymeric particles having a benzyldimethyl benzylammonium moiety, C) loading the printer with an ink jet ink composition, and D) printing on the image-receiving layer using the ink jet ink.

19 Claims, No Drawings

INK JET PRINTING METHOD

CROSS REFERENCE TO RELATED APPLICATION

Reference is made to commonly assigned, co-pending U.S. patent application Ser. No. 10/020,748 by Wang et al., filed Dec.12, 2001 entitled "Ink Jet Recording Element".

FIELD OF THE INVENTION

The present invention relates to an ink jet printing method using an ink jet recording element containing a mixture of various particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

There are generally two types of ink-receiving layers (IRL's). The first type of IRL comprises a non-porous coating of a polymer with a high capacity for swelling and absorbing ink by molecular diffusion. Cationic or anionic substances are added to the coating to serve as a dye fixing agent or mordant for the cationic or anionic dye. This coating is optically transparent and very smooth, leading to a high glossy "photo-grade" receiver. The second type of IRL comprises a porous coating of inorganic, polymeric, or organic-inorganic composite particles, a polymeric binder, and additives such as dye-fixing agents or mordants. These particles can vary in chemical composition, size, shape, and intra-particle porosity. In this case, the printing liquid is absorbed into the open pores of the IRL to obtain a print that is instantaneously dry to the touch.

A porous IRL that is glossy usually contains at least two layers: a base layer, and a glossy image-receiving layer. When coated on plain paper, the base layer is laid down underneath the glossy image-receiving layer. In order to provide a smooth, glossy surface on the image-receiving layer, special coating processes are often utilized, such as cast coating and film transfer coating. Calendering with heat and pressure is also used in combination with conventional blade or rod, or air-knife coating on plain paper to produce gloss on the image-receiving layer.

While glossy porous IRL's have the ability to absorb high concentrations of ink instantly, they suffer from image fastness problems, such as fading due to exposure to radiation by daylight, tungsten light, fluorescent light, or ozone, as described by D. E. Bugner and C. Suminski, "Filtration and Reciprocity Effects on the Fade Rate of Inkjet Photographic Prints", Proceedings of IS&T's NIP16: International Conference on Digital Printing Technologies, Vancouver, B C, October 2000. It is believed that the poor image fastness may be attributed to the greater permeability of the porous IRL's to oxygen and/other airborne reactants such as ozone.

EP 1,002,660 relates to a porous ink jet recording element comprising fine particles, hydrophilic binder and a water-soluble, cationic polymer. However, there is a problem with this element in that the density of an image printed on such an element using a water-soluble cationic polymer is lower than one would like.

It is an object of this invention to provide an inkjet printing method employing a glossy ink jet recording element that provides good surface gloss, fast drying time, and excellent image fastness.

SUMMARY OF THE INVENTION

This and other objects are achieved in accordance with the invention which comprises an ink jet printing method comprising the steps of A) providing an ink jet printer that is responsive to digital data signals;

B) loading the printer with ink jet recording element comprising a support having thereon in order:
   (I) a base layer comprising at least about 50% by weight of inorganic particles; and
   (II) an image-receiving layer comprising:
      a) colloidal, inorganic oxide particles having a mean particle size of from about 10 to about 500 nm; and
      (b) water-insoluble, cationic, polymeric particles having a benzyldimethyl benzylammonium moiety;

C) loading the printer with an ink jet ink composition; and

D) printing on the image-receiving layer using the ink jet ink By use of the invention, a recording element is obtained that has good gloss, fast drying time and excellent image fastness.

DETAILED DESCRIPTION OF THE INVENTION

As noted above, the base layer contains at least about 50% by weight of inorganic particles. In a preferred embodiment of the invention, the base layer contains at least about 70% by weight of inorganic particles. In another preferred embodiment, the inorganic particles in the base layer comprise calcium carbonate, magnesium carbonate, kaolin, clay, talc, calcium sulfate, barium sulfate, titanium dioxide, zinc oxide, zinc hydroxide, zinc carbonate, aluminum silicate, calcium silicate, magnesium silicate, synthetic amorphous silica, fumed silica, colloidal silica, silica gel, aluminum gel, fumed alumina, colloidal alumina, pseudo-boehmite, or zeolite. In another preferred embodiment, these inorganic particles in the base layer have an anionic surface charge. In yet another preferred embodiment, these inorganic particles in the base layer have a mean particle size of from about 100 nm to about 5 $\mu$m.

In still another preferred embodiment, the base layer contains a binder such as a polymeric material and/or a latex material, such as poly(vinyl alcohol) and/or styrene-butadiene latex. In still another preferred embodiment, the binder in the base layer is present in an amount of from about 5 to about 20 weight %. In still another preferred embodiment, the thickness of the base layer may range from about 5 μm to about 50 μm, preferably from about 20 to about 40 μm.

Examples of colloidal, inorganic oxide particles useful in the invention include alumina, boehmite, clay, calcium carbonate, titanium dioxide, calcined clay, aluminosilicates, silica, barium sulfate, or polymeric beads. The particles may be porous or nonporous. In a preferred embodiment of the invention, the particles are metallic oxides, preferably fumed. In another preferred embodiment, the colloidal, inorganic oxide particles are fumed alumina, fumed silica, silica or hydrous aluminum oxide. Fumed oxides are available in dry form or as dispersions of the aggregates. In another preferred embodiment, the colloidal, inorganic oxide particles have a mean particle size of from about 50 to about 200 nm.

Porosity of the ink-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small so that they do not scatter visible light.

In a preferred embodiment of the invention, the image-receiving layer also contains a polymeric binder in an amount insufficient to alter the porosity of the porous receiving layer. In another preferred embodiment, the polymeric binder is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is a core/shell latex. The polymeric binder should be chosen so that it is compatible with the aforementioned particles.

The amount of binder used should be sufficient to impart cohesive strength to the inkjet recording element, but should also be minimized so that the interconnected pore structure formed by the aggregates is not filled in by the binder. In a preferred embodiment of the invention, the binder is present in an amount of from about 5 to about 20 weight %

In a preferred embodiment of the invention, the water-insoluble, cationic, polymeric particles having a benzyldimethyl benzylarnmonium moiety used have the formula:

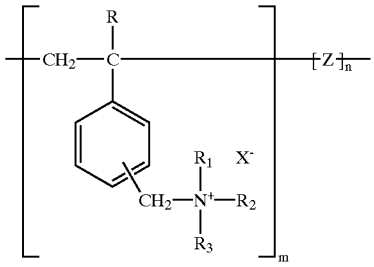

wherein:

R represents H or an alkyl group of from 1 to about 4 carbon atoms;

$R_1$ and $R_2$ each independently represents an alkyl group of from 1 to about 20 carbon atoms;

$R_3$ represents a benzyl group;

Z represents at least one ethylenically unsaturated, nonionic monomer;

m represents a mole % of from about 5 to about 100, preferably from about 10 to about 90;

n represents a mole % of from 0 to about 95; and

X represents an anion.

As noted above, Z in the formula represents at least one ethylenically unsaturated, nonionic monomer. Examples of these include methyl acrylate, ethyl acrylate, ethyl methacrylate, benzyl acrylate, benzyl methacrylate, propyl acrylate, propyl methacrylate, iso-propyl acrylate, iso-propyl methacrylate, butyl acrylate, butyl methacrylate, hexyl acrylate, hexyl methacrylate, octadecyl methacrylate, octadecyl acrylate, lauryl methacrylate, lauryl acrylate, hydroxyethyl acrylate, hydroxyethyl methacrylate, hydroxyhexyl acrylate, hydroxyhexyl methacrylate, hydroxyoctadecyl acrylate, hydroxyoctadecyl methacrylate, hydroxylauryl methacrylate, hydroxylauryl acrylate, phenethylacrylate, phenethyl methacrylate, 6-phenylhexyl acrylate, 6-phenylhexyl methacrylate, phenyllauryl acrylate, phenyllaurylmethacrylate, 3-nitrophenyl-6-hexyl methacrylate, 3-nitrophenyl-18-octadecyl acrylate, ethyleneglycol dicyclopentyl ether acrylate, vinyl ethyl ketone, vinyl propyl ketone, vinyl hexyl ketone, vinyl octyl ketone, vinyl butyl ketone, cyclohexyl acrylate,3-methacryloxypropyl-dimethylmethoxysilane, 3-methacryloxypropyl-methyldimethoxysilane,3-methacryloxypropyl pentamethyldisiloxane, 3-methacryloxypropyl tris(trimethylsiloxy)silane,3-acryloxypropyl-dimethylmethoxysilane, acryloxypropylmethyldimethoxysilane, trifluoromethyl styrene, trifluoromethyl acrylate, trifluoromethyl methacrylate, tetrafluoropropyl acrylate, tetrafluoropropyl methacrylate, heptafluorobutyl methacrylate, isobutyl acrylate, isobutyl methacrylate, 2-ethylhexyl acrylate, 2-ethylhexyl methacrylate, isooctyl acrylate, isooctyl methacrylate, N,N-dihexyl acrylamide, N,N-dioctyl acrylamide, vinyl propionate, vinyl acetate, vinyl butyrate, vinyl butyl ether, and vinyl propyl ether. ethylene, styrene, vinyl carbazole, vinyl naphthalene, vinyl anthracene, vinyl pyrene, methyl methacrylate, methyl acrylate, alpha-methylstyrene, dimethylstyrene, methylstyrene, vinylbiphenyl, glycidyl acrylate, glycidyl methacrylate, glycidyl propylene, 2-methyl-2-vinyl oxirane, vinyl pyridine, maleimide, N-pbenyl maleimide, N-hexyl maleimide, N-vinyl-phthalimide, and N-vinyl maleimide. poly(ethylene glycol) methyl ether acrylate, vinyl pyrrolidone, vinyl 4-methylpyrrolidone, vinyl 4-phenylpyrrolidone, vinyl imidazole, vinyl 4-methylimidazole, vinyl 4-phenylimidazole, acrylamide, methacrylamide, N,N-dimethyl acrylamide, N-methyl acrylamide, N-methyl methacrylamide, aryloxy dimethyl acrylamide, N-methyl acrylamide, N-methyl methacrylamide, aryloxy piperidine, N,N-dimethyl acrylamide, allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, triethylene glycol dimethacrylate, 1,4-butanediol dimethacrylate, 1,3-butanediol dimethacrylate, pentaerythritol tetraacrylate, trimethylol propane trimethacrylate and polyfunctional aromatic compounds such as divinylbenzene and the like.

In a preferred embodiment of the invention, the water-insoluble, cationic, polymeric particles have a mean particle size of from about 5 to about 500 nm, preferably from about 10 to about 200 nm. The water-insoluble, cationic, polymeric particles may be used in an amount of from about 0.2 to about 32 g/m$^2$, preferably from about 0.4 to about 16 g/m$^2$.

In another preferred embodiment of the invention, the water-insoluble, cationic, polymeric particles comprise poly (styrene-co-vinylbenzyl dimetbylbenzylammonium chloride-co-divinylbenzene).

The thickness of the image-receiving layer may range from about 5 to about 40 $\mu$m, preferably from about 10 to about 20 $\mu$m. The coating thickness required is determined through the need for the coating to act as a sump for absorption of ink solvent and the need to hold the ink near the coating surface.

After coating, the ink jet recording element may be subject to calendering or supercalendering to enhance surface smoothness. In a preferred embodiment of the invention, the ink jet recording element is subject to hot, soft-nip calendering at a temperature of about 65° C. and pressure of 14000 kg/m at a speed of from about 0.15 m/s to about 0.3 m/s.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek®, synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, rod coating, air knife coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following example is provided to illustrate the invention.

EXAMPLE

Preparation of Base Layer Coating Solution 1

A coating solution was prepared by mixing (1) 242.6 g of water (2) 225.6 g of Albagloss-s® precipitated calcium carbonate (Specialty Minerals Inc.) at 70 wt. %

(3) 8.75 g of silica gel Crosfield 23F® (Crosfield Ltd.)

(4) 8.75 g of Airvol 125® poly(vinyl alcohol) (Air Products Co.) at 10 wt. %

(5) 14.3 g of styrene-butadiene latex CP692NA® (Dow Chemical Co.) at 50 wt. %

Preparation of Image-Receiving Layer Coating Solutions

Preparation of a Modified Colloidal Silica Particle Dispersion A

To 325 g of Nalco 2329® solution, 40% solids, (Nalco Co.) was added at room temperature dropwise 1.29 g of aminopropyl methyl dimethoxysilane under stirring. The reaction was allowed to continue at room temperature for 24 hours before use.

Image-Receiving Layer Coating Solution 1:

This solution was prepared by combining 269 g of the above Dispersion A, 15 g of Kymene Plus®, (Hercules Corp.), 44 g of a core/shell particle emulsion [silica core and poly(butyl acrylate) shell], 40% solids, as prepared by the procedure as described in Example 1 of U.S. patent application Ser. No. 09/535,703, filed Mar. 27, 2000, 82 g of poly(vinylbenzyl trimethylammonium chloride-co-divinylbenzene) (87:13 molar ratio) emulsion (15% solids), and 1.12 g of surfactant Zonyl® FSN. Poly(vinylbenzyl trimethylammonium chloride-co-divinylbenzene) is a cationic polymer particle having a mean particle size of about 65 nm and a benzyl trimethyl ammonium moiety.

Image-Receiving Layer Coating Solution 2:

This solution was prepared the same as Image-Receiving Layer Coating Solution 1 except that 82 g of poly( styrene-co-vinylbenzyl dimethylbenzylammonium chloride-co-divinylbenzene) (49.5:49.5:1.0 molar ratio) emulsion (20% solids) was used instead of poly(vinylbenzyl trimethylammonium chloride-co-divinylbenzene) (87:13 molar ratio). Poly(styrene-co-vinylbenzyl dimethylbenzylammonium chloride-co-divinylbenzene) is a cationic polymer particle having a mean size of about 60 nm and a benzyl dimethylbenzylammonium moiety.

Image-receiving Layer Coating Solution 3:

This solution was prepared the same as Image-Receiving Layer Coating Solution 2 except that the amount of the poly(styrene-co-vinylbenzyl dimethylbenzylammonium chloride-co-divinylbenzene) (49.5:49.5:1.0 molar ratio) emulsion used was 105.6 g.

Image-receiving Layer Coating Solution 4:

This solution was prepared the same as Image-Receiving Layer Coating Solution 2 except that the amount of the poly(styrene-co-vinylbenzyl dimethylbenzylammonium chloride-co-divinylbenzene) (49.5:49.5:1.0 molar ratio) emulsion used was 123.2 g.

Preparation of Ink Jet Recording Elements

Element C-1 (Comparative):

Base Layer Coating Solution 1 was coated onto a photographic paper and dried at about 90° C. to give a dry thickness of about 25 $\mu$m or a dry coating weight of about 27 g/m$^2$.

Image-Receiving Layer Coating Solution 1 was coated on the top of the base layer and dried at 90° C. to give a dry thickness of about 8 $\mu$m or a dry coating weight of about 8.6 g/m$^2$.

Element 1 (Invention):

Element 1 was prepared as Element C-1 except that Image-Receiving Layer Coating Solution 2 was used.

Element 2 (Invention):

Element 2 was prepared as Element C-1 except that Image-Receiving Layer Coating Solution 3 was used.

Element 3 (Invention)

Element 3 was prepared as Element C-1 except that Image-Receiving Layer Coating Solution 4 was used.

Printing and Testing

The above elements were printed using a Kodak PPM 200 printer using color cartridges number 195–1730. The image consisted of adjacent patches of cyan, magenta, yellow, black, green, red and blue patches, each patch being in the form of a rectangle 0.4 cm in width and 1.0 cm in length.

Gloss

The above recording elements were measured for 60° specular glossiness using a Gardener® Gloss Meter.

Light Fade Testing

The images were then subjected to ambient fluorescence white light fading test for up to two weeks. The reflection density nearest to 1.0 was compared before and after fade and a percent density loss was calculated for the magenta dye. The following results were obtained:

TABLE 1

| Element | Gloss[1] | Gloss[2] | Magenta Density Loss (%)[1] | Magenta Density Loss (%)[2] |
|---|---|---|---|---|
| C-1 | 30 | 52 | 65 | 58 |
| 1 | 29 | 49 | 25 | 21 |
| 2 | 27 | 51 | 17 | 18 |
| 3 | 24 | — | 16 | 13 |

[1]Before calendering

[2]After calendering at 0.42 × 10$^6$ kg/m$^2$ (600 psi) and 52° C.

The above results show that the elements employed in the invention had less magenta density loss before and after calendering as compared to the control element, while maintaining good gloss.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method comprising the steps of:

A) providing an ink jet printer that is responsive to digital data signals;

B) loading said printer with ink jet recording element comprising a support having thereon in order:

(I) a base layer comprising at least about 50% by weight of inorganic particles; and (II) an image-receiving layer comprising:

a) colloidal, inorganic oxide particles having a mean particle size of from about 10 to about 500 nm; and (b) water-insoluble, cationic, polymeric particles having a benzyldimethyl benzylammonium moiety;

C) loading said printer with an ink jet ink composition; and

D) printing on said image-receiving layer using said ink jet ink composition in response to said digital data signals.

2. The method of claim 1 wherein said inorganic particles in said base layer have an anionic surface charge.

3. The method of claim 1 wherein said inorganic particles in said base layer have a mean particle size of from about 100 nm to about 5 $\mu$m.

4. The method of claim 1 wherein said base layer comprises at least about 70% by weight of inorganic particles.

5. The method of claim 1 wherein said inorganic particles in said base layer comprise calcium carbonate, magnesium carbonate, kaolin, clay, talc, calcium sulfate, barium sulfate, titanium dioxide, zinc oxide, zinc hydroxide, zinc carbonate, aluminum silicate, calcium silicate, magnesium silicate, synthetic amorphous silica, fumed silica, colloidal silica, silica gel, aluminum gel, fumed alumina, colloidal alumina, pseudo-boehmite, or zeolite.

6. The method of claim 1 wherein said base layer also contains a binder in an amount of from about 5 to about 20 weight %.

7. The method of claim 1 wherein said colloidal, inorganic oxide particles are fumed alumina, fumed silica, silica or hydrous aluminum oxide.

8. The method of claim 1 wherein said colloidal, inorganic oxide particles have a mean particle size of from about 50 to about 200 nm.

9. The method of claim 1 wherein said image-receiving layer also contains a binder in an amount of from about 5 to about 20 weight %.

10. The method of claim 9 wherein said binder is a hydrophilic polymer.

11. The method of claim 9 wherein said binder is a core/shell latex.

12. The method of claim 1 wherein said support is coated with said base layer and said image-receiving layer and is then calendered.

13. The method of claim 1 wherein said water-insoluble, cationic, polymeric particles having a benzyldimethyl benzylammonium moiety have the formula:

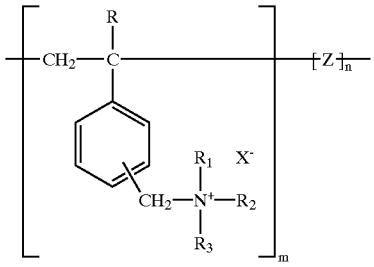

wherein:

R represents H or an alkyl group of from 1 to about 4 carbon atoms;

$R_1$ and $R_2$ each independently represents an alkyl group of from 1 to about 20 carbon atoms;

$R_3$ represents a benzyl group;

Z represents at least one ethylenically unsaturated, non-ionic monomer;

m represents a mole % of from about 5 to about 100;

n represents a mole % of from 0 to about 95, and

X represents an anion.

14. The method of claim 13 wherein said m represents a mole % of from about 10 to about 90.

15. The method of claim 1 wherein said water-insoluble, cationic, polymeric particles have a mean particle size of from about 5 to about 500 nm.

16. The method of claim 1 wherein said water-insoluble, cationic, polymeric particles have a mean particle size of from about 10 to about 200 nm.

17. The method of claim 1 wherein said water-insoluble, cationic, polymeric particles are employed in an amount of from about 0.2 to about 32 g/m$^2$.

18. The method of claim 1 wherein said water-insoluble, cationic, polymeric particles are employed in an amount of from about 0.4 to about 16 g/m$^2$.

19. The method of claim 1 wherein said water-insoluble, cationic, polymeric particles comprise poly(styrene-co-vinylbenzyl dimethylbenzylammonium chloride-co-divinylbenzene).

* * * * *